United States Patent [19]

Schwartz et al.

[11] Patent Number: 4,976,407

[45] Date of Patent: Dec. 11, 1990

[54] ADJUSTABLE WRIST SUPPORT

[75] Inventors: Edward M. Schwartz, Kansas City; Wilburn D. Everman, Belton, both of Mo.

[73] Assignee: Edtech Company, Kansas City, Mo.

[21] Appl. No.: 450,146

[22] Filed: Dec. 13, 1989

[51] Int. Cl.[5] ..... B43L 15/00

[52] U.S. Cl. ..... 248/118.3; 400/715

[58] Field of Search ..... 248/118, 118.1, 118.3, 248/118.5; 211/69.1; 108/43; 400/715

[56] References Cited

U.S. PATENT DOCUMENTS

| | | | |
|---|---|---|---|
| 1,135,155 | 4/1915 | Blundell | 248/118.3 |
| 1,801,669 | 4/1931 | Hintz et al. . | |
| 4,482,063 | 11/1984 | Berke et al. | 248/118 X |
| 4,570,803 | 2/1986 | Peterson | 211/88 |
| 4,621,781 | 11/1986 | Springer | 400/715 X |
| 4,688,862 | 8/1987 | Fowler et al. | 312/325 |

FOREIGN PATENT DOCUMENTS

| | | |
|---|---|---|
| 1913287 | 9/1970 | Fed. Rep. of Germany . |
| 2910855 | 10/1980 | Fed. Rep. of Germany . |
| 2074948 | 11/1981 | United Kingdom . |

OTHER PUBLICATIONS

Sauter et al., *Improving VDT Work: Causes and Control of Health Concerns in VDT Use,* Chap. 9, "Preventing Problems in the Arms and Hands", pp. 27–32.

*Primary Examiner*—Ramon O. Ramirez

*Attorney, Agent, or Firm*—Sughrue, Mion, Zinn, Macpeak & Seas

[57] ABSTRACT

A device for supporting the wrists of a keyboard operator or typist. The device includes a support member for supporting the operator's wrists, a mounting bracket adapted to be mounted on a base, a pair of connecting members respectively extending from the mounting bracket and the wrist support member, each of the connecting members having a slot disposed therein, and a pin extending parallel to the support member through each of the slots in the connecting member so as to respectively connect the pair of connecting members extending from the mounting bracket to the pair of connecting members extending from the wrist support member. In this manner, the wrist support member is pivotably adjustable relative to the mounting bracket about an axis which is disposed parallel to the mounting bracket, and the wrist support member is translatably adjustable in two directions angularly disposed with respect to one another. Therefore, the wrist support members are independently adjustable in three directions providing the operator with a large degree of adjustability.

7 Claims, 3 Drawing Sheets

FIG. 1
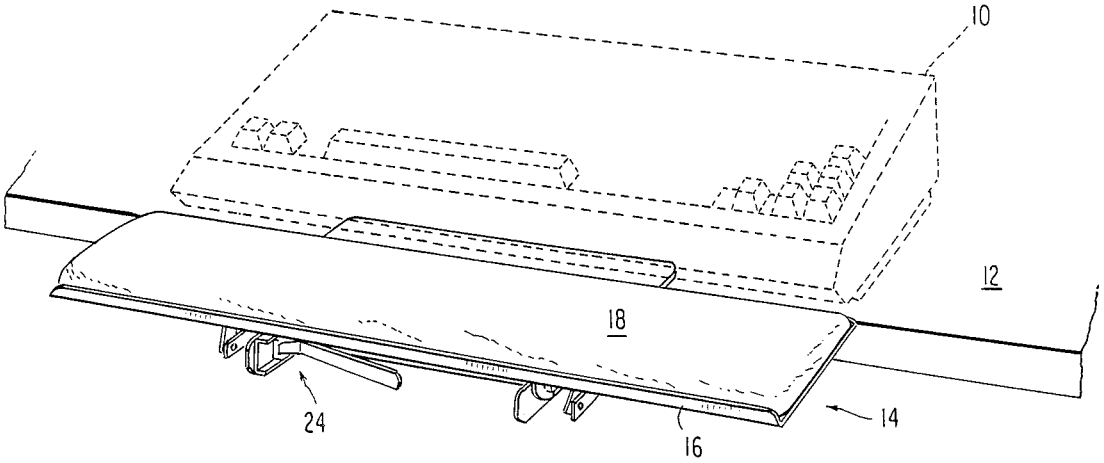
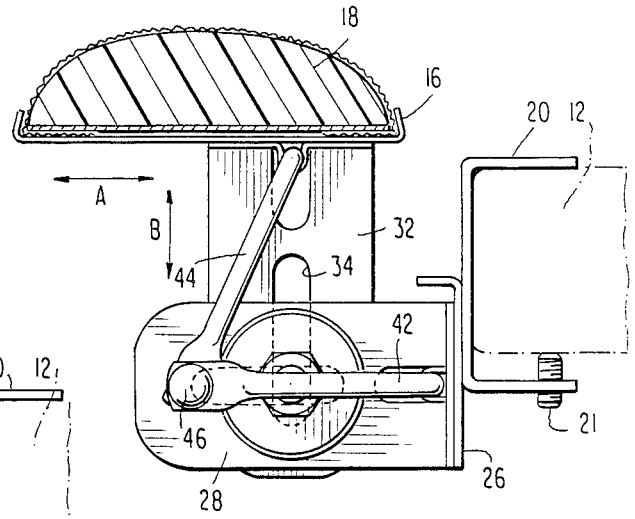
FIG. 4
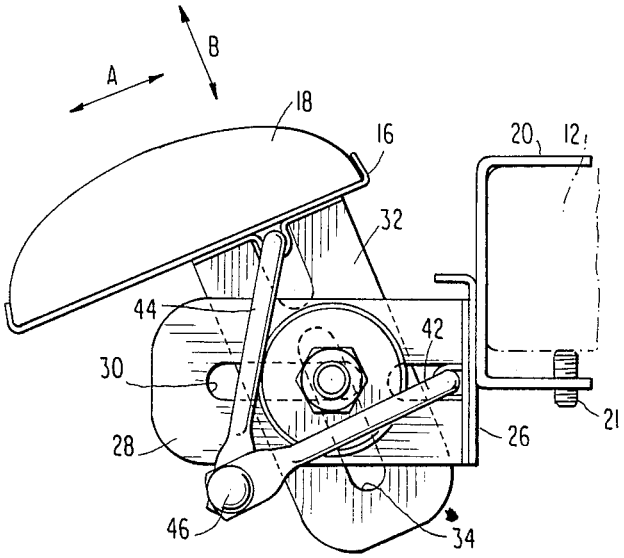
FIG. 5

ADJUSTABLE WRIST SUPPORT

BACKGROUND OF THE INVENTION

1. Field of the Invention

The invention relates to an adjustable wrist support for supporting the wrists of typists and VDT operators.

2. Background

There are at least 10 million video display terminals (hereinafter referred to as VDTs) in use across the country, and it is predicted that there will be greater than 40 million VDTs by the end of this century. While VDTs are used for a variety of tasks. they are used most intensively by a range of office workers who may spend the entire day key punching and processing information. It is estimated that typists and VDT operators make many thousand key strokes per hour. Each stroke requires the contraction of a muscle and movement of a tendon in the forearm. With high movement rates, there exists a possibility of damage to the muscles and tendons as a result of the sliding action. The potential for muscle and tendon damage becomes greater when the arms and hands are used in awkward positions. Accordingly, to prevent this damage, it is necessary to ensure that the typists' or VDT operators' hands be maintained in the proper position for typing. Thus, it is necessary to provide an adjustable wrist support so as to permit a typist's or VDT operator's wrist to be supported in the proper position.

U.S. Pat. No 4.688.862 discloses an adjustable arm and/or hand rest member which is adjustable in the upward and downward direction as well as the inward and outward direction. In particular, the adjustable member is slidably disposed in an arcuate slot so as to permit the bi-directional movement. However, the problem associated with the adjustable member disclosed in U.S. Pat. No. 4,688,862 is that the vertical adjustment of the adjustable member is dependent upon the horizontal adjustment of the adjustable member. Thus, the adjustable member does not permit the necessary adjustable freedom to accommodate typists and VDT users of different size and having different typing styles.

SUMMARY OF THE INVENTION

It is an object of this invention to provide a wrist support which is freely adjustable. More particularly, it is the object of this invention to provide a wrist support which is independently and/or simultaneously adjustable in both the horizontal and vertical directions and which is pivotably adjustable. This and other objects which will become apparent from the ensuing description of the preferred embodiment of the invention are accomplished according to the present invention by a wrist support comprising a support member for supporting the operator's wrists, a mounting bracket adapted to be mounted on a base, a pair of connecting members extending from the mounting bracket and the wrist support member, respectively, each of the connecting members having a slot disposed therein, and a pin extending parallel to said support member through each of the slots in the connecting members so as to respectively connect the pair of connecting members extending from the mounting bracket to the pair of connecting members extending from the wrist support member. In this manner, the wrist support member is pivotably adjustable relative to the mounting bracket about an axis which is disposed parallel to the mounting bracket, and the wrist support member is translatably adjustable in two directions angularly disposed with respect to one another The wrist support member is independently adjustable in three directions providing the operator with a greater degree of adjustability than the conventional wrist support device.

BRIEF DESCRIPTION OF THE DRAWINGS

FIG. 1 is a perspective view of an embodiment of the wrist support device according to the present invention:

FIG. 4 is a sectional view taken substantially along the line of 4—4 of FIG. 2

FIG. 5 is a side view of the embodiment of FIG. 1:

DETAILED DESCRIPTION OF THE INVENTION

Figure 2:
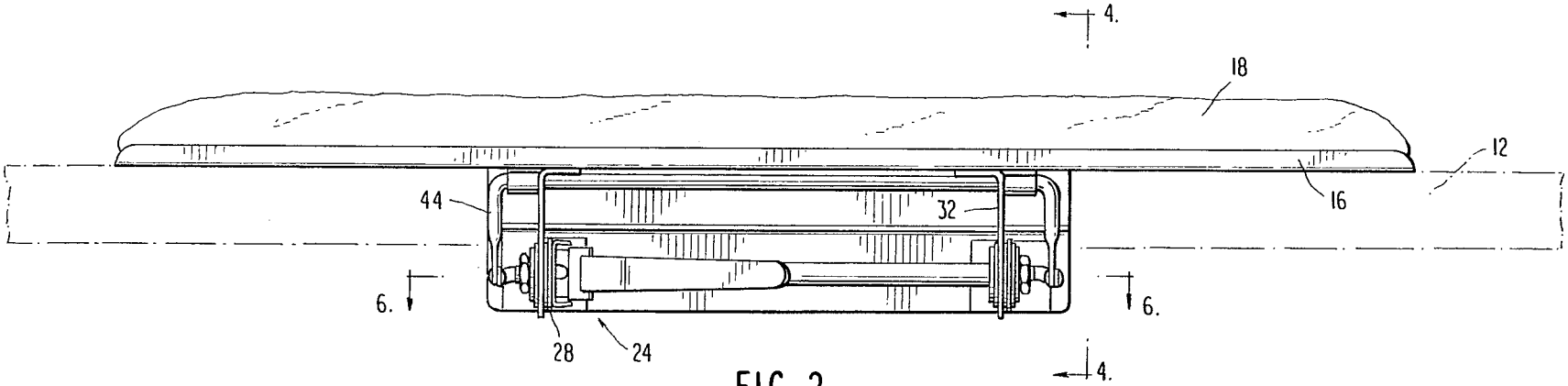
FIG. 2 is a front elevational view of the embodiment of FIG. 1.

Referring to FIG. 1, a keyboard 10 is supported on tabletop 12 in the conventional manner. According to the invention, the wrist support device 14 is secured to the tabletop 12, as illustrated in FIG. 1. The wrist support device 14 comprises a support bar 16 upon which a pad 18 is disposed, a mounting bracket 20 for mounting the device on the tabletop 12 and an articulating mechanism 22 for adjustably securing the support bar 16 to the mounting bracket 20. As will be described in further detail hereinafter, the device further includes a locking mechanism 24 for locking the support bar in the desired position.

Figure 3:
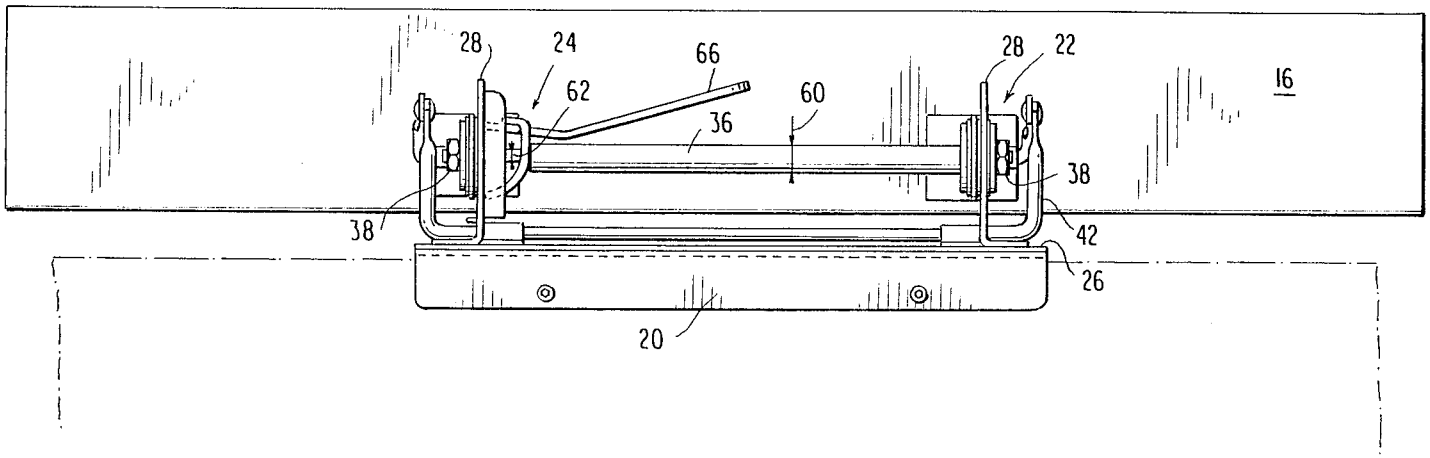
FIG. 3 is a bottom view of the embodiment of FIG. 1.

Referring to FIGS. 2 through 5, the articulating mechanism will be described as follows. As best illustrated in FIGS. 4 and 5, the articulating mechanism includes an L-shaped support bracket 26 which is fixedly secured to mounting bracket 20. A pair of connecting members 28 having slots 30 disposed therein extend perpendicularly from the support bracket 26. Correspondingly, a pair of connecting members 32 having slots 34 disposed therein extend perpendicularly from the support bar 16. The connecting members are appropriately spaced apart from one another in the manner illustrated in FIGS. 1–3. As illustrated in FIG. 3, a bolt 36, extending parallel to the mounting bracket 20 and support bar 16, is disposed in the slots 30, 34 for respectively connecting the first connecting members 28 to the second connecting members 32. An annular spacer 37 circumscribes the bolt. A nut 38, washer 39 and friction members 41 are disposed on opposite ends of the bolt 36 to rotatably fasten the bolt 36 to the connecting members 28, 32. Of course, it is understood that any fastening means would suffice.

Thus, according to the invention, the support bar 16 is adjustably secured to support bracket 26 via connecting members 28. 32. Since each of the connecting members 28, 32 have slots 30. 34 disposed therein for receiving bolt 36, the support bar 16 is independently adjustable in three directions. In particular, as illustrated in FIGS. 4 and 5, the support bar 16 is rotatably adjustable with respect to the support bracket 26 and is also translatably adjustable in two directions. The direction of the translatable adjustability depends on the angular position of the support bar 16 with respect to the support bracket 26. In particular, the direction of the translational adjustability corresponds to the position of the respective connecting members 28, 32. That is, the support bar 16 is slidably adjustable in the direction of the respective slot 30, 34 orientation of the connecting members 28, 32, as illustrated by the arrows A. B in FIGS. 4 and 5. Thus, according to the present invention, the support bar can be adjusted to substantially any desired position to accommodate operators of different sizes and having different keypunching styles.

To provide additional stability to the articulating mechanism 22, according to the invention, a linkage mechanism 40 may be provided. Referring to FIGS. 4 and 5, the linkage mechanism includes a pair of first links 42 which are pivotably secured at one end thereof to the support bracket 26 and a pair of second links 44 which are pivotably supported at one end thereof to support bar 16. The other ends of the $ first and second links 42. 44 are pivotably secured to one another by a pin 46. As illustrated in FIGS. 2 and 3, the pair of first links are connected to each other in the form of a U-shape while the second links 44 are also connected to each other to form a U-shape. Of course, it is understood that the links need not be connected to each other in the manner illustrated. The linkage mechanism 40 is not required for the wrist support to function, but does serve to provide additional stability to the wrist support device.

Figure 6:
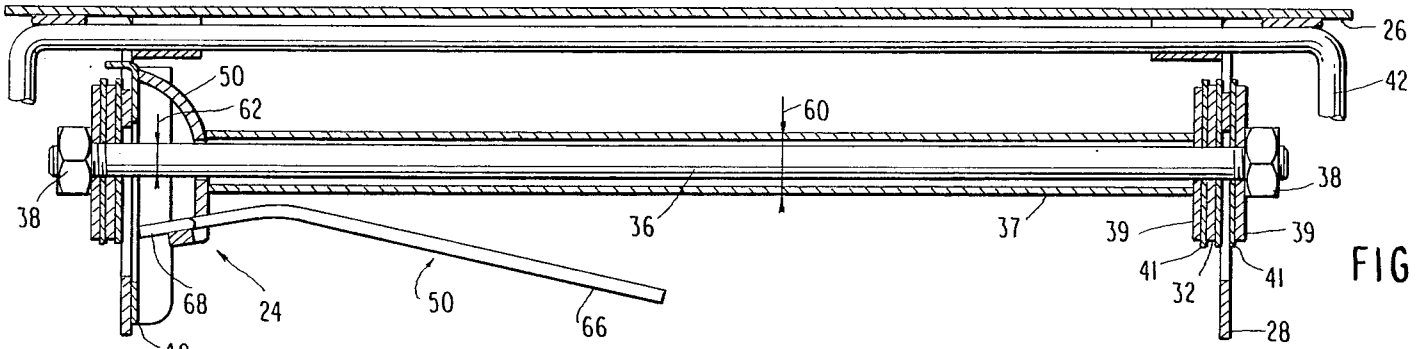
FIG. 6 is a sectional view taken substantially along the line 6—6 of FIG. 2.
Figure 8:
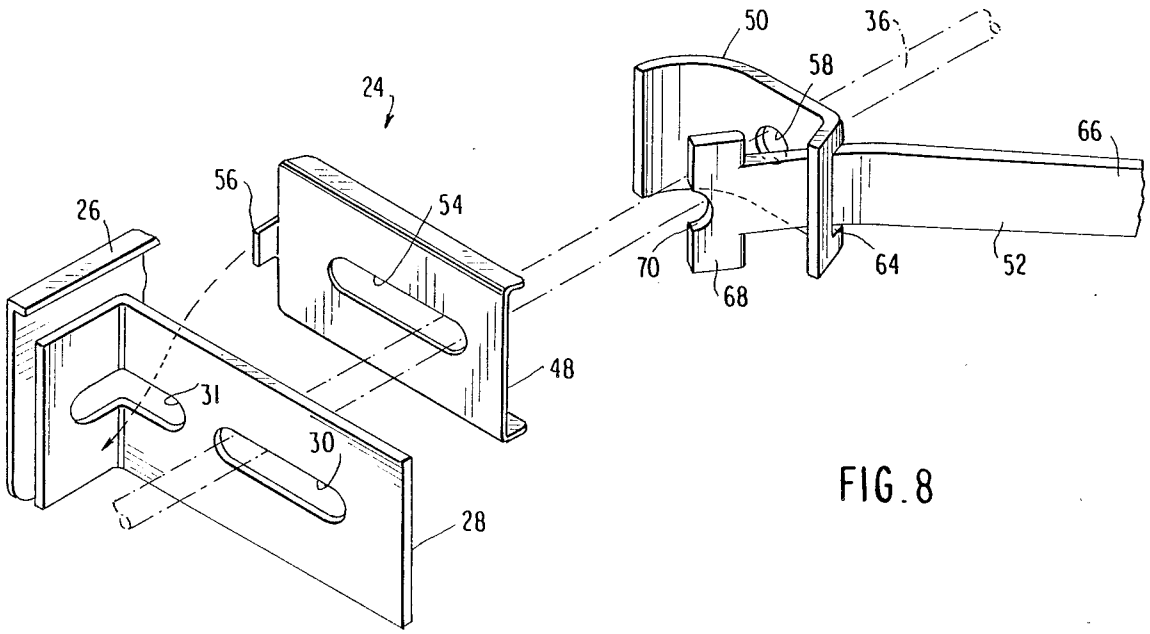
FIG. 8 is an exploded perspective view of the locking device of the FIG. 1 embodiment.

As noted above, a locking mechanism 24 is provided for securing the support bar in a desired position. FIGS. 6. 7 and 8 specifically illustrate the locking mechanism 24. Referring thereto, the locking mechanism includes a friction pad 48, lever bracket 50 and lever 52. Referring specifically to FIG. 8, the friction pad includes a slot 54 having dimensions corresponding to slot 30 of connecting member 28. Additionally, the friction pad 48 includes an engaging tab 56 which protrudes through slot 31 of the connecting member 28. The friction pad 48 is disposed adjacent connecting member 28 and is prevented from rotating with respect thereto by engagement of the engaging tab 56 with slot 31.

The lever bracket 50 is substantially U-shaped and includes a hole 58 disposed therein for receiving bolt 36. As noted above, an annular spacer 37 circumscribes the bolt 36, as illustrated in FIG. 3. The diameter of the lever bracket hole 58 is slightly greater than the diameter 62 of the bolt 36 but less than the diameter 60 of the spacer 37. Thus, in this manner, as illustrated in FIG. 3, the lever bracket 50 is prevented from moving inwardly along the axial direction of the bolt 36. The lever bracket 50 also includes a slot 64.

Figure 7:
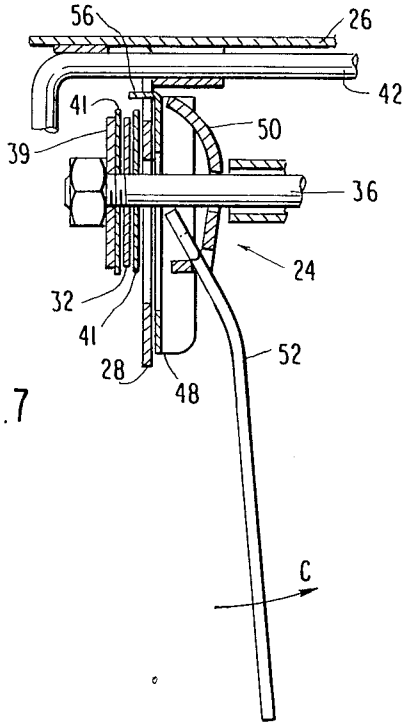
FIG. 7 is a partial view of the locking device for locking the wrist support device of the embodiment of FIG. 1.

The lever 52 includes a lever arm 66 and a lever block 68 disposed at one end of the lever arm 66. The lever arm extends through the slot 64 of the lever bracket 50 such that the lever block 68 is disposed between the lever bracket 50 and the friction pad 48 while the lever arm 66 protrudes away from the lever o bracket 50. The lever block 68 includes a slotted portion 70 so as to permit the bolt 36 to pass therethrough. Thus, as illustrated in FIG. 7, when the lever 52 is positioned such that the lever block 68 does not engage the friction pad 48, the locking mechanism is disengaged so that the support bar 16 can be adjusted. Once the support bar 16 is adjusted to the desired position, the operator pushes the lever 52 in the direction of the arrow C illustrated in FIG. 7. In this manner, the lever block 68 urges the friction pad 48 against the connecting member 28 such that the connecting member 28 extending from the support bracket 26 is frictionally engaged with the connecting member 32 extending from the support bar 16, as illustrated in FIG. 6. In this manner, the wrist support mechanism is maintained in the desired position.

As illustrated in FIG. 4, the mounting bracket 20 is substantially U-shaped such that it may be mounted to the tabletop 12 in the manner illustrated therein. A set screw 21 is threadably engaged with the mounting bracket 20 so as to engage the bottom of the tabletop 12 such that the wrist support mechanism is frictionally secured to the tabletop 12.

While the present invention has been illustrated and described in relation to a specific embodiment, it should be understood that such showing and description have been given by way of illustration, and not by way of limitation.

What is claimed is:

1. A support for supporting the wrist of a typist or VDT operator during operation of a keyboard, said support comprising:

wrist support means for supporting said operator's wrist;

mounting means for mounting said wrist support means to a base which is adapted to support said keyboard, such that said wrist support means is disposed in front of said keyboard; and articulating means connecting said wrist support means to said mounting means for allowing three-directional independent adjustability of said wrist support means, such that said wrist support is independently and/or simultaneously adjustable in both a horizontal and a vertical direction and is also pivotably adjustable.

2. The support of claim 1, further comprising locking means for locking said wrist support means in a fixed position, said wrist support being lockable in any increment of its horizontal, vertical or pivotal range.

3. The support of claim 1, wherein said support means is pivotably adjustable relative to said mounting means about an axis disposed parallel to said mounting means and said support means and is translatably adjustable in two directions angularly disposed with respect to one another.

4. A support for supporting the wrist of a typist or VDT operator, comprising:

wrist support means for supporting said operator's wrist;

mounting means for mounting said wrist support means to a base; and articulating means connecting said wrist support means to said mounting means for allowing three-directional independent adjustability of said wrist support means.

wherein said support means is pivotably adjustable relative to said mounting means about an axis disposed parallel to said mounting means and said support means and is translatably adjustable in two directions angularly disposed with respect to one another, and wherein said articulating means comprises:

a mounting bracket;

a pair of connecting members respectively extending from said mounting bracket and said wrist support means, each of said connecting members having a slot disposed therein; and a pin extending parallel to said axis through each of said slots so as to respectively connect said pair of connecting members extending from said mounting bracket to said pair of connecting members extending from said wrist support means.

5. The support of claim 4, wherein said articulating means further comprises a linkage means interconnecting said mounting bracket to said wrist support means for providing stability thereto.

6. The support of claim 4, wherein said locking means comprises a friction means for frictionally securing one of said pair of connecting members extending from said mounting bracket to one of said pair of connecting members extending from said wrist support means.

7. The support of claim 6, wherein said friction means comprises:

a friction member disposed adjacent one of said connecting members:

a lever retainer fixedly secured to said pin adjacent said friction member: and a lever pivotably secured to said retainer, one end of said lever extending between said friction member and said retainer and another end of said lever extending away from said friction member and said retainer such that pivotable movement of said lever causes said one end thereof to press said friction member against said connecting members.

* * * * *